US005239149A

United States Patent [19]

Malkin et al.

[11] Patent Number: 5,239,149

[45] Date of Patent: Aug. 24, 1993

[54] VACUUM ELECTRICAL SWITCH

[75] Inventors: Peter Malkin, St. Ismier; Roger Bolongeat-Mobleu, Echirolles, both of France

[73] Assignee: Merlin Gerin, France

[21] Appl. No.: 889,401

[22] Filed: May 28, 1992

[30] Foreign Application Priority Data

Jun. 10, 1991 [FR] France ..... 91 07474

[51] Int. Cl.[5] ..... H01H 33/66

[52] U.S. Cl. ..... 200/144 B; 200/147 R

[58] Field of Search ..... 210/144 A, 144 B, 147 R

[56] References Cited

U.S. PATENT DOCUMENTS

| | | | |
|---|---|---|---|
| 4,115,672 | 9/1978 | Lipperts | 200/144 B |
| 4,394,554 | 7/1983 | Warabi et al. | 200/144 B |
| 4,661,666 | 4/1987 | Sakuma et al. | 200/144 B |
| 4,737,607 | 4/1988 | Bernard et al. | 200/147 R |
| 5,155,315 | 10/1992 | Malkin et al. | 200/148 R |

FOREIGN PATENT DOCUMENTS

| | | |
|---|---|---|
| 0039611 | 11/1981 | European Pat. Off. . |
| 0204262 | 12/1986 | European Pat. Off. . |
| 4011194 | 8/1990 | Fed. Rep. of Germany . |
| 4013903 | 11/1990 | Fed. Rep. of Germany . |
| 2341932 | 9/1977 | France . |

*Primary Examiner*—J. R. Scott

*Attorney, Agent, or Firm*—Parkhurst, Wendel & Rossi

[57] ABSTRACT

A vacuum electrical switch comprises a coil arranged in the metal base plate of the cartridge. The metal base plate constitutes a current input to the contact, this input having a radial conducting path and a path forming a spiral, electrically connected in parallel. In order to enhance the current flow in the spiral, which forms an axial magnetic blowout coil, the base plate has ripples or a slit which lengthen the radial conducting path.

6 Claims, 2 Drawing Sheets

VACUUM ELECTRICAL SWITCH

BACKGROUND OF THE INVENTION

The invention relates to a medium voltage electrical switch with an elongated vacuum cartridge, housing a pair of contacts extending axially inside the cartridge. One contact is movable, axially slidable. The cartridge is sealed off at its ends by base plates, at least one of which is metal and comprises a center part electrically connected to one of the contacts, a current input strip arranged on the periphery of the base plate, a coil mechanically and electrically united to the base plate and connected between the strip and the center part of the base plate to form a circuitous current flow path which generates an axial field in the contact separation zone.

U.S. patent application Ser. No. 07/668,162 (now U.S. Pat. No. 5,515,315) filed by applicants describes an electrical switch of the kind mentioned in which current breaking is performed in the vacuum cartridge. The axial magnetic field generated by the current flowing in the coil increases the breaking capacity of the cartridge by causing diffusion of the arc and preventing any concentration of energy at a particular point. This coil is coaxial to the cartridge and flattened in shape, and it can be formed either by a conductor fixed by welding to the base plate, or be defined by a spiral groove cutout of the bulk piece, i.e. out of the thickness of the base plate on the internal face of the cartridge.

This state-of-the-art switch gives satisfaction but it has proved of interest to increase the intensity of the axial magnetic arc blowout field, and the object of the present invention is to achieve such an increase while preserving the simple structure of the cartridge.

SUMMARY OF THE INVENTION

The electrical switch according to the invention is characterized in that the electrical resistance of the radial conducting path between the strip and the center part, formed by said base plate, is increased thereby allowing an increased part of the current to flow through the coil which generates the arc blowout field.

The invention is based on the observation that only the current flowing in the spiral generates an axial magnetic field, the part of the current flowing along the radial path being unused or inactive.

According to the invention, the electrical resistance of the radial path is increased in order to branch most of the current to the coil which generates the arc blowout field. The electrical resistance of the radial path can be increased in different ways, notably by lengthening this radial path, obtained by ripples of the base plate or by a slit arranged at the interface of the spiral with the base plate.

According to an alternative embodiment, a coil formed by an electrical conductor is welded to the base plate, and materials of different resistivity are used (i.e. the material used for the base plate is of high resistivity to enhance current flow through the coil). All these measures may be naturally used in combination with a decrease in the thickness of the base plate in order to reduce the cross section thereof. restrict radial current flow, but this decrease is limited by a minimum mechanical strength required by the cartridge base plate.

The base plate including the axial blowout coil has the advantage of protection of the junction point between the ceramic part forming the cylindrical body of the cartridge and the metal base plate, which point is protected by the external coil acting as field distribution shield. The ripples or slit arranged in the base plate give the base plate a certain elasticity which absorbs the transmission of shocks from the contacts to the ceramic part of the cartridge.

The invention is particularly well suited to an electrical circuit breaker having a sealed enclosure filled with sulphur hexafluoride and housing main contacts, and arcing contacts parallel to the main contacts and housed in a vacuum cartridge. In such a circuit breaker, the arcing contacts open after the main contacts have separated. The invention will be described in this preferred application and the reader should advantageously refer to the above-mentioned patent for further details.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
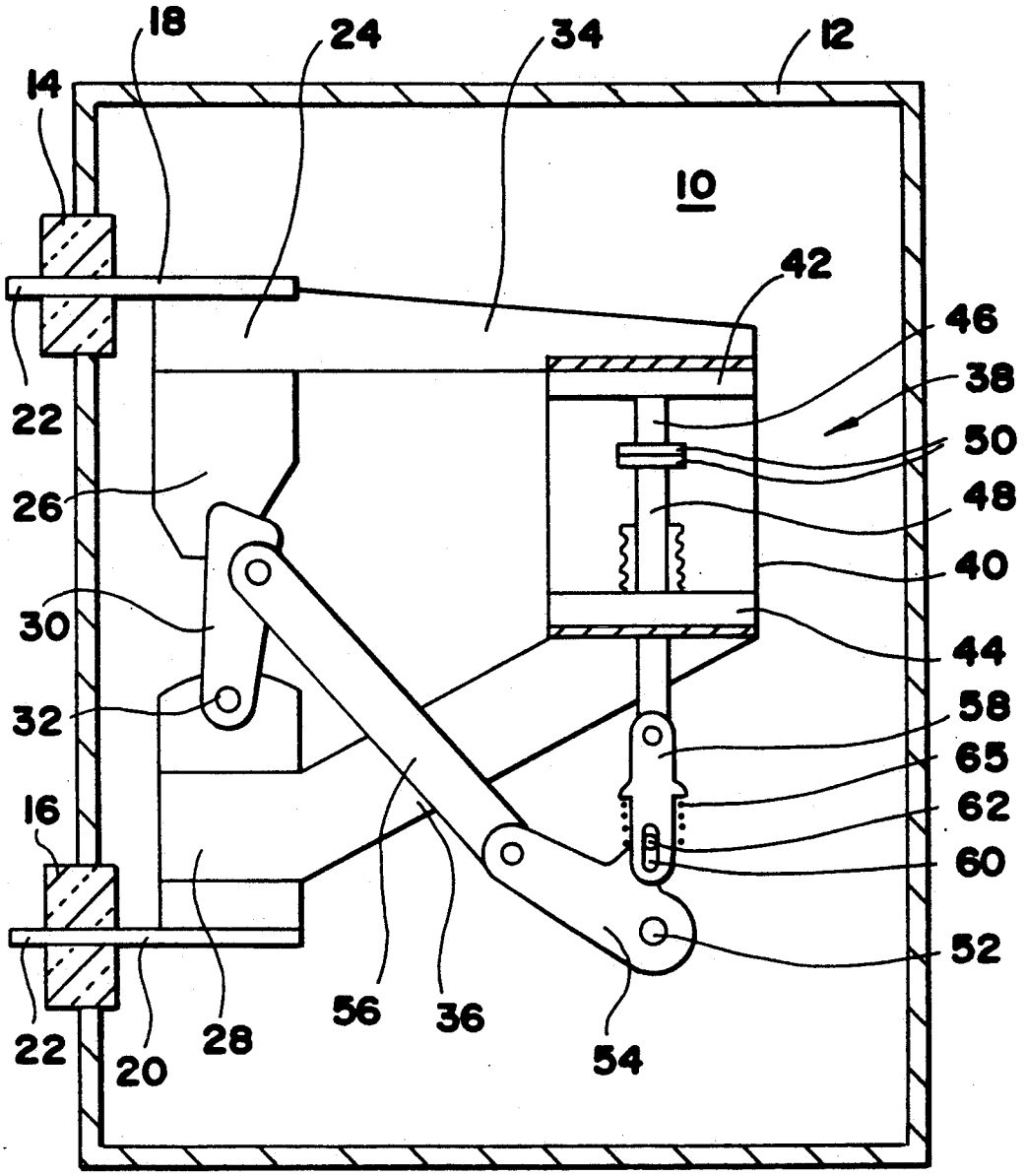
FIG. 1 is a schematic axial sectional view of a circuit breaker with vacuum cartridge according to the invention.

FIG. 1 depicts a medium voltage circuit breaker with sealed enclosure 10, whose metal or insulating wall 12 may be that of a gas-insulated installation or substation, or that of a pole or of three poles of the circuit breaker. The pole represented in FIG. 1 comprises two sealed bushings 14,16 of current input and output conductors 18 and 20, respectively which are terminated outside the enclosure 10 by connection terminals 22 and inside respectively by a support 24 of a stationary main contact 26 and by a support 28 of a movable main contact 30, in the form of a blade pivotally mounted on a fixed spindle 32. In the closed position the movable main contact 30 is aligned and in contact with the stationary main contact 26 to close the main circuit, formed by the input conductor 18, support 24, stationary main contact 26, movable main contact 30, support 28 and output conductor 20. The supports 24,28 are extended by arms 34,36 extending transversely and having free ends located at opposite ends of a vacuum cartridge 38. The cylindrical housing 40 of the cartridge 38 is sealed tightly at both ends by metal base plates 42,44 both of which are mechanically and electrically connected to the free end of the associated arm 34,36. The axis of the cartridge 38 is appreciably parallel to the main contacts 26,30 in the closed position. A pair of elongated arcing contacts 46,48 is arranged coaxially in the cartridge 38. The arcing contacts, stationary contact 46 fixedly secured to the base plate 42 and movable contact 48, each bear a disk-shaped contact part 50. The movable arcing contact 48 passes through the base plate 44, to which it is electrically connected, with a seal fitted. It can easily be seen that the arms 34, 36, base plates 42,44 and arcing contacts 46,48 with their abutting contact parts 50, form an auxiliary arcing circuit connected in parallel to the main contacts 26,30.

A rotating operating shaft 52 passes through the wall 12 and bears on its inside end a crank 54 connected on the one hand by an articulated rod 56 to the main contact blade 30 and on the other hand by a small rod 58 and pin-hole 60 to the movable arcing contact 48. In the pin-hole 60, arranged in the small rod 58, a gudgeon pin 62 supported by the crank 54 is slidingly mounted so as to form a dead travel connection urged in extension by a spring 65. The mechanism is arranged in such a way that in the course of a circuit breaker opening operation, brought about by a clockwise rotation of the shaft 52, the movable main contact 30 opens first, the arcing contacts 46,48 initially remaining closed due to the dead travel of gudgeon pin 62 in pin-hole 60. The current flowing through the main contacts 26,30 is switched to the arcing circuit without an arc forming on the main contacts 26,30. Further rotation of the shaft 52 causes opening of the arcing contacts 46,48 and final opening of the circuit breaker. The closing operation, brought about by a reverse rotation of the shaft 52, first closes the arcing contacts 46,48 followed by closing of the main contacts 26,30.

The cylindrical housing 40 of the vacuum cartridge 38 is made of ceramic or glass with a smooth external surface, whose axial length defines the critical creepage distance of the cartridge 38. This axial length is determined according to the voltage to provide a sufficient dielectric withstand and this length if notably less than that of a cartridge placed in air. In medium voltage this length is less than or about 15 cm and the small dimensions of the vacuum cartridge 38 make it easy to house.

The contact parts 50 of the arcing contacts 46, 48 are made of a high resistivity material, notably refractory, such as tungsten, chrome or alloys of these metals, to increase their arcing capability. The high resistivity of these materials is not a drawback, as the continuous current is taken up by the main contacts 26,30. This high resistivity even constitutes a notable advantage by reducing the currents induced in the contact parts 50.

Figure 3:
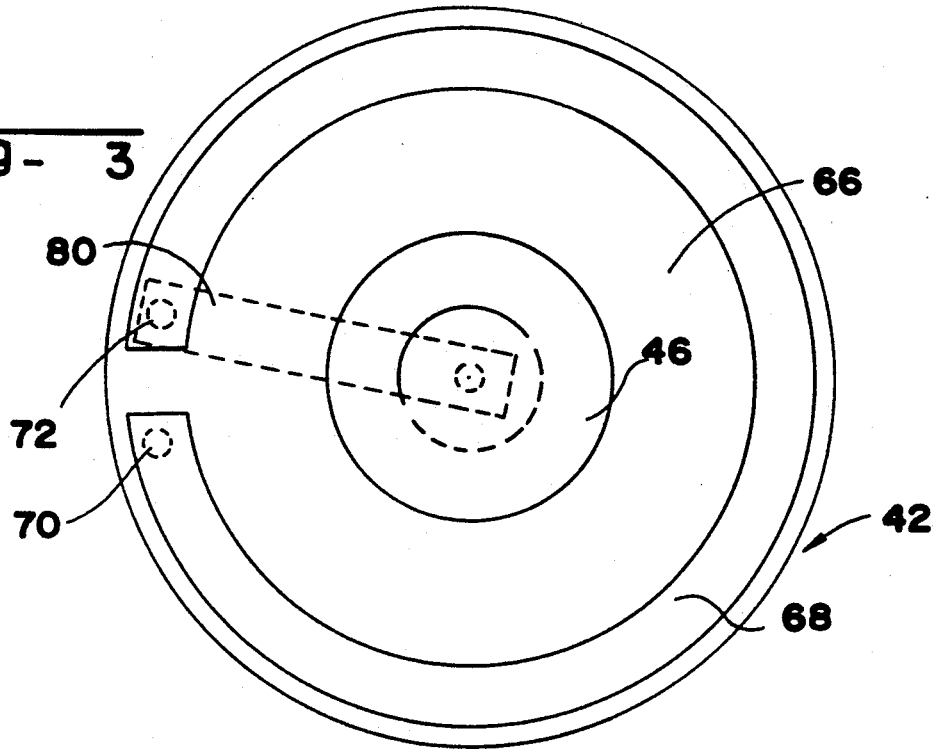
FIG. 3 is a bottom view of the base plate according to FIG. 2.
Figure 2:
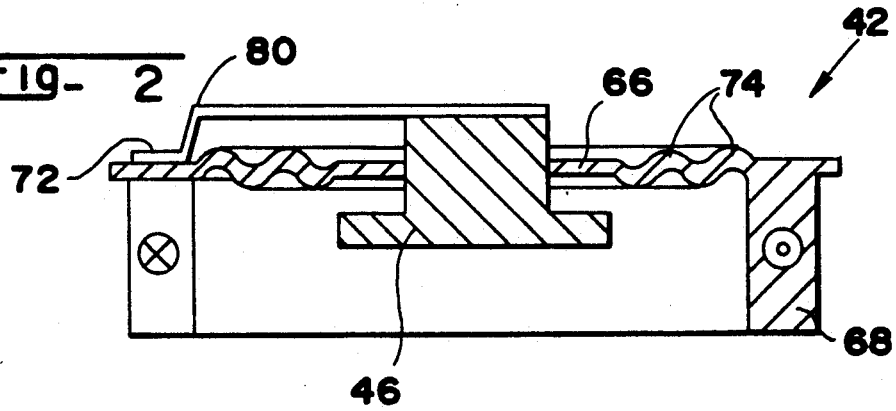
FIG. 2 is a partial view on an enlarged scale of the base plate of the cartridge according to FIG. 1.

Referring more particularly to FIGS. 2 and 3 it can be seen that the base plate 42, located on the same side as the stationary arcing contact 46, comprises a part in the form of a sheet 66 and a coil 68 of large cross section, fixedly secured to the periphery of the sheet. First end 70 of the spiral 68 is arranged as a current input strip, connected to the arm 34 and the second end 72 is connected to the center part or to the stationary contact 46 via connector 80. The current input via the arm 34 flows for a large part through the coil 68, only a small part flowing through the sheet 66. The axial field ensures diffusion of the arc and thus enables a high breaking capacity to be obtained. The sheet 66 has ripples 74 which increase the radial path of the current in the sheet 66 between the periphery of the base plate 42 and the center part, and thus increase the electrical resistance of this radial path to enhance the current flow in the coil 68. The ripples 74 give the base plate 42 a certain elasticity to absorb the shocks transmitted by the contacts to the cylindrical ceramic part 40 of the cartridge.

The ripples 74 are applicable to a base plate 42 including coil 68 formed integrally as one-piece as represented in FIG. 2, and also to a base plate bearing a separate coil fixedly secured to the base plate by welding or any other suitable means.

Figure 4:
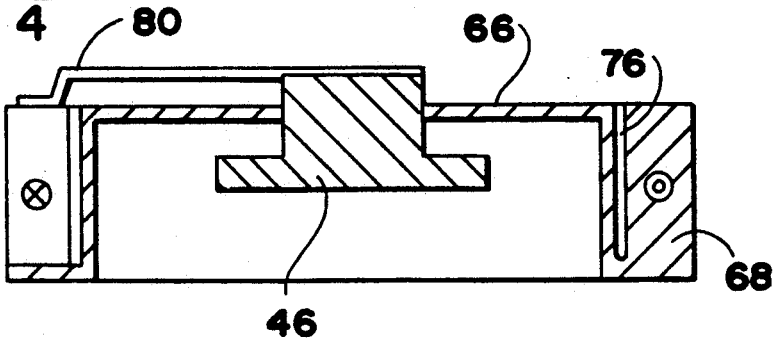
FIG. 4 is a similar view to that of FIG. 2, illustrating an alternative embodiment.

FIG. 4 illustrates an alternative embodiment in which the length of the radial path is increased by a slip 76 provided along an inner edge of coil 68. This slit 76 imposes a hairpin path for current flowing radially through the base plate 42 from the current input strip 70 to the center part, thereby increasing resistance along the radial path.

It is clear that ripples 74 or slit 76 can be combined, the effects being added to increase current flow through coil 68. In the case of an add-on coil, materials of different resistivity can also be used (e.g., a high resistivity material for the sheet 66 and a low resistivity material for the coil 68). It is clear that the simplicity of the cartridge according to the above-mentioned patent application is fully preserved while the breaking capacity and protection of the ceramic part of the cartridge are improved.

The invention has been described for a coil comprising a single spiral but it is clear that it is applicable to a coil with several spirals.

We claim:

1. A medium voltage electrical switch, comprising:

an elongated vacuum cartridge;

a stationary contact and a movable contact housed within said vacuum cartridge;

a first base plate sealing off one end of the vacuum cartridge and a second base plate sealing off an opposite end of the vacuum cartridge, each of said base plates comprising two opposite major surfaces, said first base plate comprising a central portion which is electrically conductive, said central portion being electrically connected to said stationary contact;

a coil having a first end and a second end, said coil being formed around said central portion of said first base plate on one of said two opposite major surfaces of said first base plate, said first end being electrically connected to said central portion;

a current input strip arranged on an outer periphery of said first base plate and electrically connected to said second end of said coil; and resistance means for increasing electrical resistance for current flowing radially through said first base plate to said central portion relative to electrical resistance of said coil, such that current more readily flows through said coil than radially through said first base plate toward said central portion, wherein said current flowing through said coil produces a magnetic field passing axially through said cartridge, said magnetic field acting to diffuse an arc formed by separation of said movable and stationary contacts.

2. The switch of claim 1, wherein said coil is integral with said first base plate as a single element, said coil facing an interior of the cartridge and said coil being formed along an outer periphery of said base plate.

3. The switch of claim 1, wherein the coil comprises a single spiral and is fixed to said one of said two opposite major surfaces of the first base plate along an outer periphery of said base plate.

4. The switch of claim 1, wherein said resistance means comprises ripples formed in said first base plate.

5. The switch of claim 1, wherein said resistance means comprises a slit passing through a thickness of the coil and extending along an interior edge of the coil to yield an indirect radial current flow path.

6. The switch of claim 1, wherein said resistance means is defined by said first base plate being made of a material of higher resistivity with respect to that of the material of said coil.

* * * * *